United States Patent [19]

Greenberger

[11] 4,008,533

[45] Feb. 22, 1977

[54] PRICE MARKER

[75] Inventor: William Greenberger, White Plains, N.Y.

[73] Assignee: The Hopp Press, Inc., New York, N.Y.

[22] Filed: Mar. 12, 1976

[21] Appl. No.: 666,249

[52] U.S. Cl. ..... 40/70 R

[51] Int. Cl.[2] ..... G09F 11/04

[58] Field of Search ..... 40/70 R, 115; 35/74; 273/142 R

[56] References Cited

UNITED STATES PATENTS

| | | | |
|---|---|---|---|
| 1,075,859 | 10/1913 | Rosewater | 40/70 R |
| 3,103,080 | 9/1963 | Desmond | 40/70 R |
| 3,471,956 | 10/1969 | Walters | 40/70 R |
| 3,820,263 | 6/1974 | Clark | 40/70 R |

*Primary Examiner*—Louis G. Mancene
*Assistant Examiner*—John H. Wolff

[57] ABSTRACT

A method is disclosed for interconnecting a plurality of sheets, wherein said sheets are superimposed on each other and at least one of said sheets may be rotated about the point of interconnection. The disclosure is also of novel articles such as changeable price markers constructed by the method of the invention.

1 Claim, 6 Drawing Figures

Fig. 2
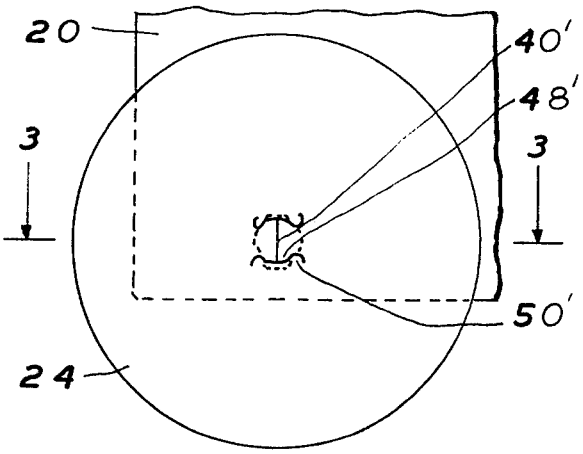
Fig. 4
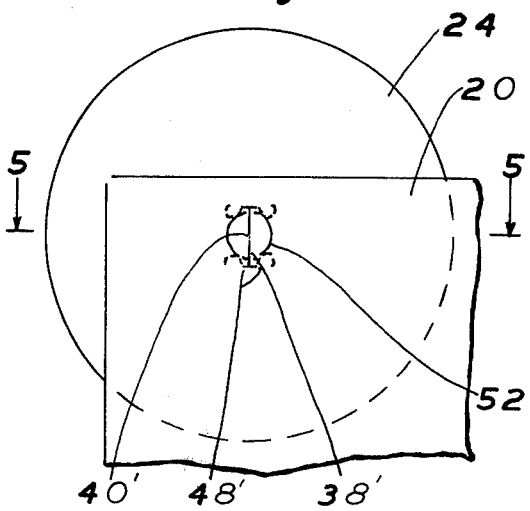
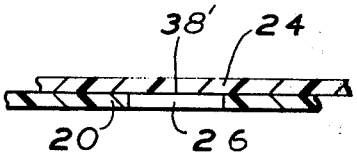
Fig. 3
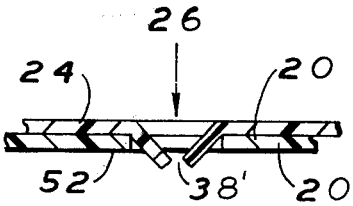
Fig. 5
Fig. 6
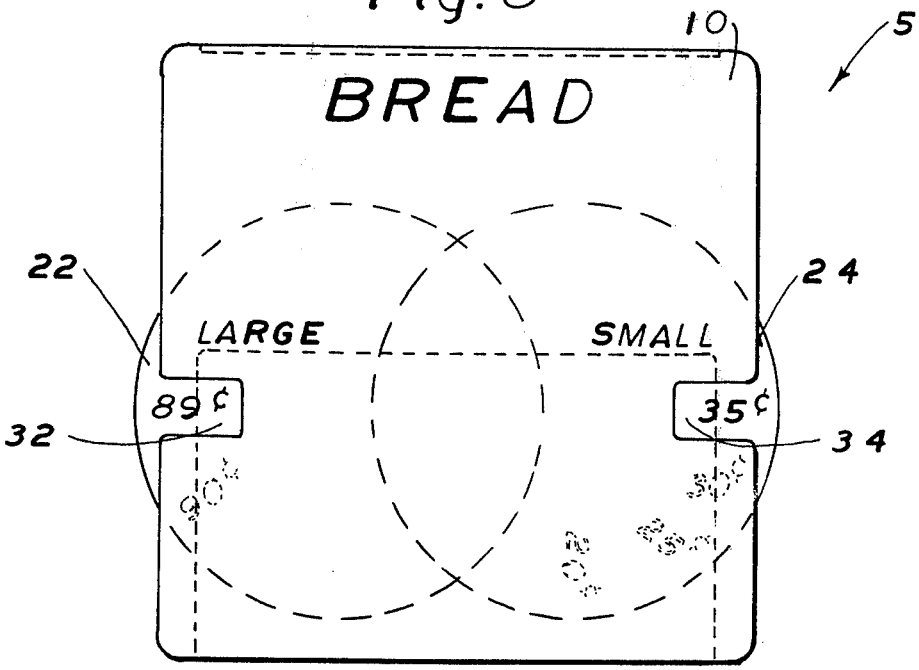

PRICE MARKER

BACKGROUND OF THE INVENTION

1. Field of the Invention

The invention relates to methods of interconnecting sheet materials and to articles constructed thereby.

2. Brief Description of the Prior Art

Sheet materials have been traditionally joined so that one sheet can be rotated while the other is held stationary by bolts or metal eyelets; see for example U.S. Pat. Nos. 1,636,991 and 2,093,714. Generally, such methods require the use of fairly sophisticated apparatus such as eyelet and eyeletting machines and the like. Also the articles produced by such methods frequently are too tightly interconnected to operate freely.

By the method of the present invention, a separate fastener component is not required. The interconnection formed can not be excessively tight and very simple apparatus will perform the interconnection. In addition, the articles produced by the method of the invention may be simply disassembled and reassembled at will, when desired, without a requirement for special tools. This is particularly advantageous when the article produced by the method is, for example, a changeable price marker which desirably may be altered upon occasion to reflect different price ranges.

SUMMARY OF THE INVENTION

The invention comprises a method of interconnecting a plurality of sheets whereby said sheets are superimposed on each other and at least one of said sheets may be rotated about the point of interconnection, which comprises; (a) providing a first sheet having an aperture therein; (b) providing a second sheet having (i) a primary first slit therein beginning at a first point and terminating at a second point, each of said points being at a position on said second sheet apart from the peripheral edge thereof, the distance between said first and second points being greater than the largest dimension of said aperture; (ii) a secondary second slit transverse to said first slit, traversing said first point, originating and terminating at third and fourth points, respectively, said third and fourth points being at positions apart from the peripheral edge of said second sheet, the distance between said third and fourth points being less than the smallest dimension of said aperture; (iii) a secondary third slit transverse to said first slit, traversing said second point, originating and terminating at fifth and sixth points, respectively, said fifth and sixth points being at positions apart from the peripheral edge of said second sheet, the distance between said fifth and sixth points being less than the smallest dimension of said aperture; (iiii) tertiary fourth, fifth, sixth and seventh slits, originating at points third, fourth, fifth and sixth, respectively, and extending at an obtuse angle to the respective secondary slits, a distance sufficient to form tabs defined by said fourth, fifth, sixth and seventh slits, respectively, together with the adjacent portions of said primary slit and said secondary slits; (c) superimposing said second sheet over said first sheet; (d) aligning the mid-point of said primary first slit with the center of said aperture; and (e) pressing said tabs through said aperture; whereby an interconnection between said first and said second sheets is obtained, permitting rotary movement between said first and second sheets.

The term "sheet" as used throughout the specification and claims means a broad, thin piece of any material. Representative of sheets are single and multilayer constructions of paper, synthetic polymeric resins such as polyethylene, polypropylene and the like, thin metal and the like.

BRIEF DESCRIPTION OF THE DRAWINGS

FIG. 2 is a fragmentary view of two sheets superimposed over each other prior to interconnection by the method of the invention;

FIG. 3 is a view along lines 3—3 of FIG. 2;

FIG. 4 is a view of the underside of the embodiment of FIG. 2 after interconnection;

FIG. 5 is a view along lines 5—5 of FIG. 4; and

FIG. 6 is a perspective view of a changeable price marker constructed according to the method of the invention.

DETAILED DESCRIPTION OF THE INVENTION

Figure 1:
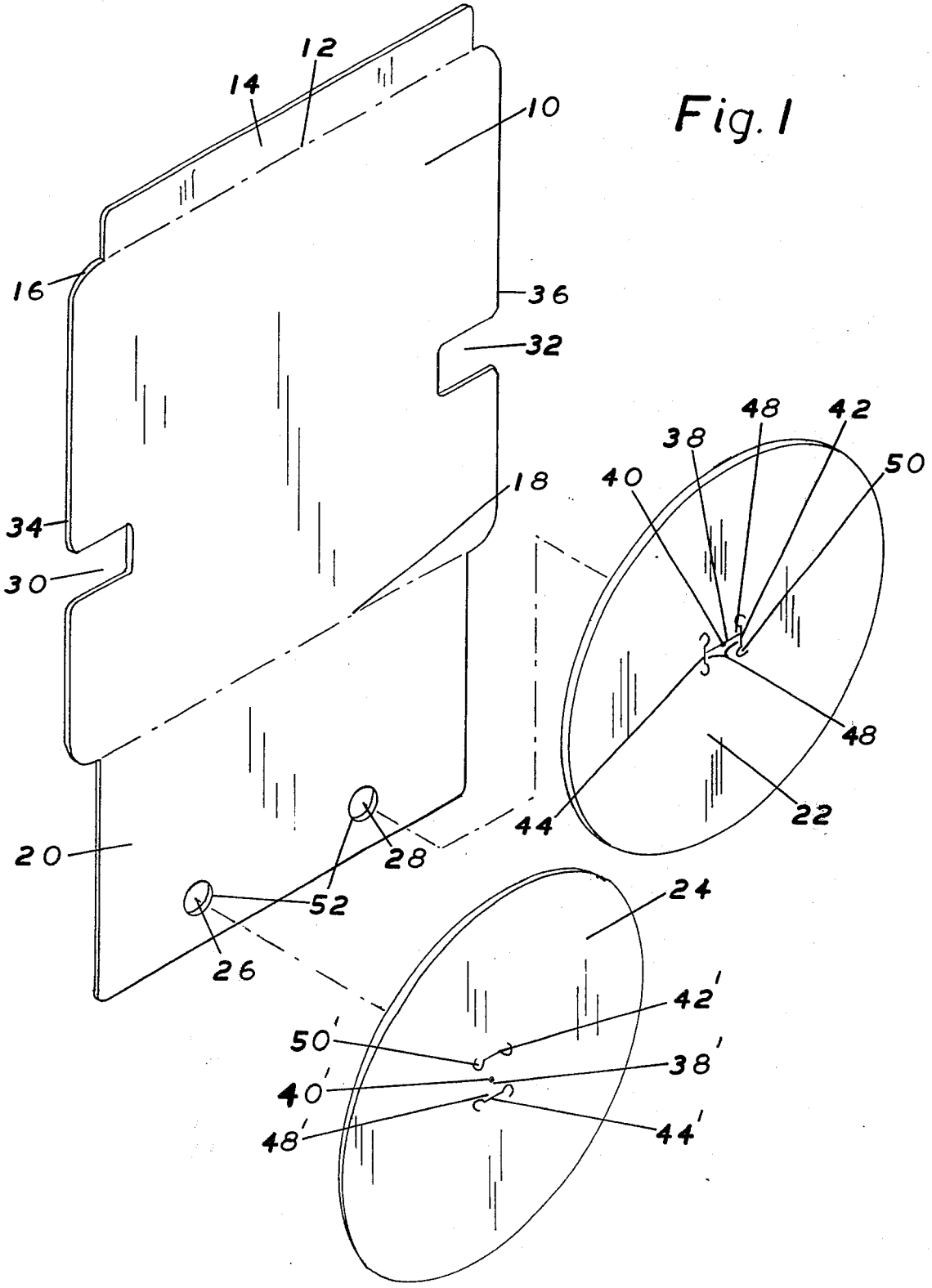
FIG. 1 is an isometric view of a plurality of sheets to be interconnected by the method of the invention.

A complete understanding of the invention may be conveniently obtained from the following description read in conjunction with the accompanying drawings of FIGS. 1–6, inclusive.

FIG. 1 is an isometric view of a plurality of sheets to be interconnected by the method of the invention. Sheet 10 may be a die-cut sheet of paper, plastic, metal or the like and as shown is relatively thin. A foldline 12 is provided at one end so tab 14 may be folded forward to form a support along upper edge 16. A foldline 18 is provided at the opposite end so that tab 20 may be folded upward to provide a support for discs 22 and 24. Round apertures 26 and 28 are provided in tab 20 and cut-away notches 30 and 32 are provided in edges 34, 36, respectively of sheet 10. The peripheral margin 52 bordering each aperture 26, 28 is a supportive surface for interconnection with another sheet as will be described hereinafter. Each of circular discs 22 and 24 may be fabricated from a relatively thin sheet of paper, plastic, metal or the like; preferably from a flexible, synthetic, polymeric resin having so-called "memory characteristics", i.e.; when flexed the material will be stressed and will seek its original configuration to relieve the stress. The center of disc 22 bears a die-cut series of slits as follows. A first slit 38, traverses the center point 40 of the disc and has substantially equal segments on each side of the center point 40. The length of slit 38 is slightly in excess of the diameter of apertures 26, 28. Secondary slits 42 and 44 traverse the ends of slit 38 and are generally transverse to slit 38. The ends of slits 42 and 44 form a portion of an arc, with the cut portion directed towards the inside of the disc 22 so tabs like tab 48 are formed by the die-cut slits 38, 42 and 44. The length of the straight portion of the slits 42 and 44 is less than the diameter of the apertures 26, 28. The center of disc 24 bears the same die-cut slits found on disc 22 and are identified in FIG. 1 by the corresponding symbols 38′, 40′, 42′, 44′ and 48′. The die-cut slits and tabs formed in the surface of discs 22, 24 serve as a means for attaching the discs 22, 24 to sheet 10 as will be hereinafter described. In the preferred embodiment of FIG. 1, the slits 42, 42′, 44 and 44′ are shown to terminate in arcuate cuts. The arcuate cut terminations of slits 42, 42′, 44 and 44′ are preferred because they form tabs 50 and 50′, respectively on the outer side of each disc 22, 24. However, formation of the latter tabs are not necessary so long as the inner tabs 48 and 48' are formed by at least an extension of the appropriate slit 42, 42', 44 and 44' at an obtuse angle to the portion traversing the ends of slits 38 or 40.

Referring now to FIG. 2, a fragmentary view of sheet 10, there is seen disc 24 superimposed over a portion of tab 20 so that center point 40' is in axial alignment with the center of aperture 26. FIG. 3, a cross-sectional view along lines 3—3 of FIG. 2 shows the positional relationship in greater detail. In the next step of the method of the invention, a pointed tool such as a pencil point is pressed against the center point 40' and the margins of the die-cut region are pushed through aperture 26. The flexible sheet material of disc 24 pushed through aperture 26 engages the opposite or back planar surface of tab 20 so as to interconnect the sheet 10 and disc 24. The interconnection may be seen in FIG. 4, a reverse view of that seen in FIG. 2 but after the interconnection has been established. FIG. 4 shows the die-cut tabs 48' overlapping and engaging a portion of the peripheral margin 52 of tab 20 surrounding aperture 26. When disc 24 is fabricated from the preferred synthetic resin having "memory", the tabs 48' are in position against margin 52 under stress and are urging themselves towards their original position in disc 24, thus firmly engaging the tab 20. On the reverse side of tab 20 (not seen), the preferred tabs 50' of disc 24 press for further support. The positional relationship of the interconnecting parts may be seen in FIG. 5, a cross-sectional view along lines 5—5 of FIG. 4.

From the above description, those skilled in the art will appreciate that the interconnection made between disc 24 and sheet 10 is movable and either disc 24 or sheet 10 may be rotated or pivoted about the point of interconnection while the other of disc 24 or sheet 10 remains stationary or is rotated in an opposite direction. The tabs 48' (or 48 in disc 22) act as bearing surfaces during such movement. The interconnection is relatively simple, does not require a third connecting component, is flat and permits the mounting of additional sheets overlapping the connection without interfering with the established interconnection. When desired, attached disc 24 may be removed merely by pressing the tabs 48' back through aperture 26 in the direction of disc 24. This permits one to replace the disc 24 at will without special tools.

The disc 26 is connected to tab 20 of sheet 10 in the same manner as described above for disc 24 except interconnection is effected through aperture 28. When the interconnection is made, tab 20 is folded upward along foldline 18 (see FIG. 1) and tab 14 is folded downward along foldline 12. The article so obtained is shown in FIG. 6, a front view of a changeable price marker 5. Marker 5 displays price indicia printed on one planar surface of disc 22 through the notch 32 in sheet 10 and price indicia printed on one planar surface of disc 24 through notch 34 in sheet 10. The discs 22 and 24 may be rotated to display through respective notches 32, 34 any desired indicia printed on the discs 22, 24. Each disc 22 and 24 may be rotated independently of the other. In the marker 5, the discs 22, 24 bear price indicia printed annularly about the planar surface proximal to the sheet 10. As will be observed, marker 5 need not have the discs 22, 24 mounted concentrically to each other but may be positioned independent of each other. A particular advantage of the method of interconnecting the discs 22, 24 to sheet 10 resides in the flat, thin interconnection without a need for an eyelet or bolt. This permits one to mount or interconnect any number of rotatable discs on sheet 10 or on each other without interference from a pivotable component.

What is claimed is:

1. A changeable price marker, which comprises; a first sheet having an aperture therein; a circular second sheet having 1. a primary first slit therein beginning at a first point and terminating at a second point, each of said points being at a position on said second sheet apart from the peripheral edge thereof, the distance between said first and second points being greater than the largest dimension of said aperture;
2. a secondary second slit transverse to said first slit, traversing said first point, originating and terminating at third and fourth points, respectively, said third and fourth points being at positions apart from the peripheral edge of said second sheet;
3. a secondary third slit transverse to said first slit, traversing said second point, originating and terminating at fifth and sixth points, respectively, said fifth and sixth points being at positions spaced apart from the peripheral edge of said second sheet;
4. tertiary fourth, fifth, sixth and seventh slits originating at points third, fourth, fifth and sixth, respectively, and extending at an obtuse angle to the respective secondary slits, a distance sufficient to form tabs defined by said fourth, fifth, sixth and seventh slits, respectively, together with the adjacent portions of said primary slit and said secondary slits;

said first and second sheets being interconnected by superimposing said second sheet over said first sheet, aligning the mid-point of said primary first slit with the center of said aperture and pressing said tabs through said aperture;

whereby said interconnection permits rotary movement between said first and second sheets;

said second sheet having printed on a planar surface pricing indicia; and a portion of said first sheet foldable over said second sheet, a cutout section of said portion exposing said pricing indicia to view.

* * * * *